US007705662B2

(12) United States Patent
Ng et al.

(10) Patent No.: US 7,705,662 B2
(45) Date of Patent: Apr. 27, 2010

(54) LOW VOLTAGE HIGH-OUTPUT-DRIVING CMOS VOLTAGE REFERENCE WITH TEMPERATURE COMPENSATION

(75) Inventors: Chik Wai David Ng, Kowloon (HK); Kwok Kuen David Kwong, Davis, CA (US)

(73) Assignee: Hong Kong Applied Science and Technology Research Institute Co., Ltd, Hong Kong (HK)

( * ) Notice: Subject to any disclaimer, the term of this patent is extended or adjusted under 35 U.S.C. 154(b) by 2 days.

(21) Appl. No.: 12/237,500

(22) Filed: Sep. 25, 2008

(65) Prior Publication Data

US 2010/0073070 A1 Mar. 25, 2010

(51) Int. Cl.
*G05F 3/02* (2006.01)

(52) U.S. Cl. ..... 327/539; 327/513

(58) Field of Classification Search ..... 327/539, 327/513; 323/313–314
See application file for complete search history.

(56) References Cited

U.S. PATENT DOCUMENTS

| | | | | |
|---|---|---|---|---|
| 4,282,477 | A * | 8/1981 | Ahmed | 323/312 |
| 5,889,394 | A * | 3/1999 | Czarnocki | 323/313 |
| 5,900,773 | A | 5/1999 | Susak | |
| 6,489,835 | B1 | 12/2002 | Yu et al. | |
| 6,509,783 | B2 * | 1/2003 | Chowdhury | 327/513 |
| 6,531,857 | B2 * | 3/2003 | Ju | 323/316 |
| 6,795,052 | B2 * | 9/2004 | Lin et al. | 345/101 |
| 7,113,025 | B2 * | 9/2006 | Washburn | 327/539 |
| 7,259,543 | B2 | 8/2007 | Chih | |
| 7,301,321 | B1 * | 11/2007 | Uang et al. | 323/313 |
| 7,307,468 | B1 * | 12/2007 | Vasudevan | 327/539 |
| 2005/0127987 | A1 * | 6/2005 | Sato et al. | 327/539 |
| 2006/0164158 | A1 * | 7/2006 | Kimura | 327/539 |
| 2007/0080741 | A1 * | 4/2007 | Yeo et al. | 327/539 |
| 2009/0146685 | A1 * | 6/2009 | Kim et al. | 326/33 |
| 2009/0174468 | A1 * | 7/2009 | Yoshida et al. | 327/539 |

OTHER PUBLICATIONS

Mal, P., F.Mal, C.Fioccho and M.Pruzzi, "Curvature-Compensated BiCMOS Bandgap with 1-V Voltage," IEEE J. Solid-State, vol. 36, No. 7, p. 1076-81, Jul. 2001.

(Continued)

*Primary Examiner*—Lincoln Donovan
*Assistant Examiner*—Thomas J Hiltunen
(74) *Attorney, Agent, or Firm*—Stuart T. Auvinen; gPatent LLC

(57) ABSTRACT

A bandgap reference voltage generator has a first stage that generates a first current that is complementary-to-absolute-temperature (Ictat) and a second stage that generates a current that is proportional-to-absolute-temperature (Iptat). The Ictat and Iptat currents are both forced through a summing resistor to generate a voltage that is relatively independent of temperature, since the Ictat and Iptat currents cancel out each other's temperature dependencies. A PMOS output transistor drives current to an output load to maintain the load at the reference voltage. An op amp drives the gate of the PMOS output transistor and has inputs connected to emitters of PNP transistors in the second stage. A series of resistors generate the reference voltage between the PMOS output transistor and ground and drives bases of the PNP transistors and includes the summing resistor. Parasitic PNP transistors in an all-CMOS process are used. The generator operates with a 1-volt power supply.

17 Claims, 7 Drawing Sheets

OTHER PUBLICATIONS

Leung, K.N. and Mok, P., "A Sub-1-V 15-ppm/oC CMOS Bandgap Voltage Reference Without Requiring Low Threshold Voltage Device," IEEE J. Solid-State, vol. 37, No. 4, pp. 526-530, Apr. 2002.

Widlar R. J. "New developments in IC voltage regulators," IEEE J.Solid-State Circuits, vol. SC-6, No. 1, pp. 2-7, Feb. 1971.

Leung K.N., P. K. T. Mok, and C. Y. Leung, "A 2-V 23-A curvature compensated CMOS bandgap voltage reference," IEEE J. Solid-State Circuits, vol. 38, No. 3, pp. 561-564, pp. 561-564 Mar. 2003.

Ker, M.D and Chen, J.S, "New Curvature-Compensation Technique for CMOS bandgap Reference With Sub-1-V Operation," IEEE Trans. Circuits Syst. II, vol. 53, No. 8, pp. 667-671, Aug. 2006.

* cited by examiner

LOW VOLTAGE HIGH-OUTPUT-DRIVING CMOS VOLTAGE REFERENCE WITH TEMPERATURE COMPENSATION

FIELD OF THE INVENTION

This invention relates to bandgap voltage reference circuits, and more particularly to temperature-compensated reference circuits implemented in all complementary metal-oxide-semiconductor (CMOS) technologies.

BACKGROUND OF THE INVENTION

Many kinds of electronic circuits such as voltage regulators and analog-to-digital converters compare voltages as a fundamental part of their operation. For example, an operational amplifier (op amp) compares two voltages applied to its input, and then amplifies the detected voltage difference. One of the applied voltages may be an external voltage that varies depending on operating conditions and events, while the other input is a relatively fixed voltage known as a reference voltage.

Ideally, the reference voltage would be a truly fixed voltage that never varied in voltage. However, reference voltages in real-life systems often vary significantly with variations in temperature, power-supply voltage, noise from other circuits, loading of its output, etc. Circuit designers try to minimize these variations in reference voltages by careful and creative circuit design.

While an external reference could be applied to a system, the high level of integration desired in today's systems provides significant cost and size savings when the reference is generated on-chip. Bandgap voltage reference circuits are widely popular for internal reference circuits, since the reference voltage ultimately depends on well-understood semiconductor device properties such as voltages produced at p-n junctions.

Traditional bandgap reference circuits used bipolar transistors such as PNP transistors. However, most high-integration systems use complementary metal-oxide-semiconductor (CMOS) technology. A hybrid technology with both CMOS and bipolar transistors known as BiCMOS has been used, but it is more expensive than standard CMOS. Additional mask layers are often used with BiCMOS, and power consumption is usually higher.

The higher circuit density on today's integrated circuit chips is made possible by shrinking device sizes. These smaller transistors have thinner insulator layers and are not able to withstand voltages that were used just a few years ago. Power supply voltages of 5 volts could break down transistors that are now designed for 2 or 1.5-volt power supplies.

While power supply voltages have been reduced to prevent damage to the smaller transistors used in today's circuits, other fundamental device characteristics have not tracked. For example, the transistor threshold voltage has remained at about 0.7 to 0.5 volts. As further device shrinks require that power supplies be reduced to near 1.0 volt, design of circuits that can still operate and turn on transistors using a 0.5 to 0.7 volt threshold is challenging.

Many bandgap reference circuits can only operate using power supply voltage above 2 volts. Some bandgap reference circuits that are designed to operate with 1-volt supplies suffer from low current amplification (low beta), and sacrifice current drive strength to achieve low-voltage operation. Poor power-supply rejection ratios (PSRR) and noise due to large impedances are typical.

Bandgap reference circuits can be difficult to implement when the power supply is close to 1 volt since turning on an op amp from a PNP transistor reference requires that the NMOS transistor threshold voltage Vth be less than the base-emitter junction voltage Vbe. Since Vtn and Vbe are close to each other, process yields may be low due to this requirement.

Bandgap reference circuits may feed into amplifiers that will amplify any noise that is injected into the sensitive bandgap reference circuit. Noise may be fed back into the bandgap reference circuit from its load, especially when the load is insufficiently driven by a low current drive amplifier. The reference voltage may then fluctuate due to loading noise, and this noise may even be amplified.

What is desired is a bandgap reference circuit that can be implemented in a standard CMOS process using a parasitic PNP transistor. A bandgap reference circuit that can operate with a 1-volt power supply and yet still have a high current drive to its load is desirable. A bandgap reference circuit with a low startup voltage and good line regulation and noise rejection is desirable. A bandgap reference circuit that compensates for temperature is desirable.

DETAILED DESCRIPTION

The present invention relates to an improvement in CMOS bandgap reference circuits. The following description is presented to enable one of ordinary skill in the art to make and use the invention as provided in the context of a particular application and its requirements. Various modifications to the preferred embodiment will be apparent to those with skill in the art, and the general principles defined herein may be applied to other embodiments. Therefore, the present invention is not intended to be limited to the particular embodiments shown and described, but is to be accorded the widest scope consistent with the principles and novel features herein disclosed.

The inventors have realized that a bandgap reference circuit can generate a referenced voltage that is conceptually the sum of two internal reference voltages: a complementary-to-absolute temperature (CTAT) reference voltage Vctat, and a proportional-to-absolute temperature (PTAT) reference voltage Vptat. A first stage uses the parasitic PNP transistor to generate Vctat, while a second stage generates Vptat and combines it with Vctat to generate the output reference voltage Vref.

The parasitic PNP transistor may be formed in a standard CMOS process, so that a more expensive BiCMOS process is not needed. The combination of Vctat with a negative temperature coefficient and Vptat with a positive temperature coefficient produces a temperature-compensated reference voltage despite the low power supply voltage.

Figure 1B:
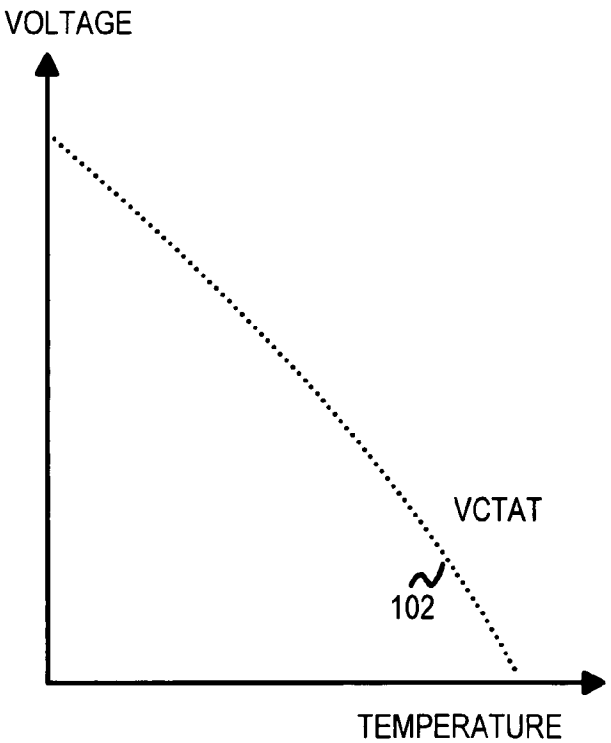
FIG. 1B shows that the Vctat voltage across summing resistor 60 decreases as temperature increases.
Figure 1A:
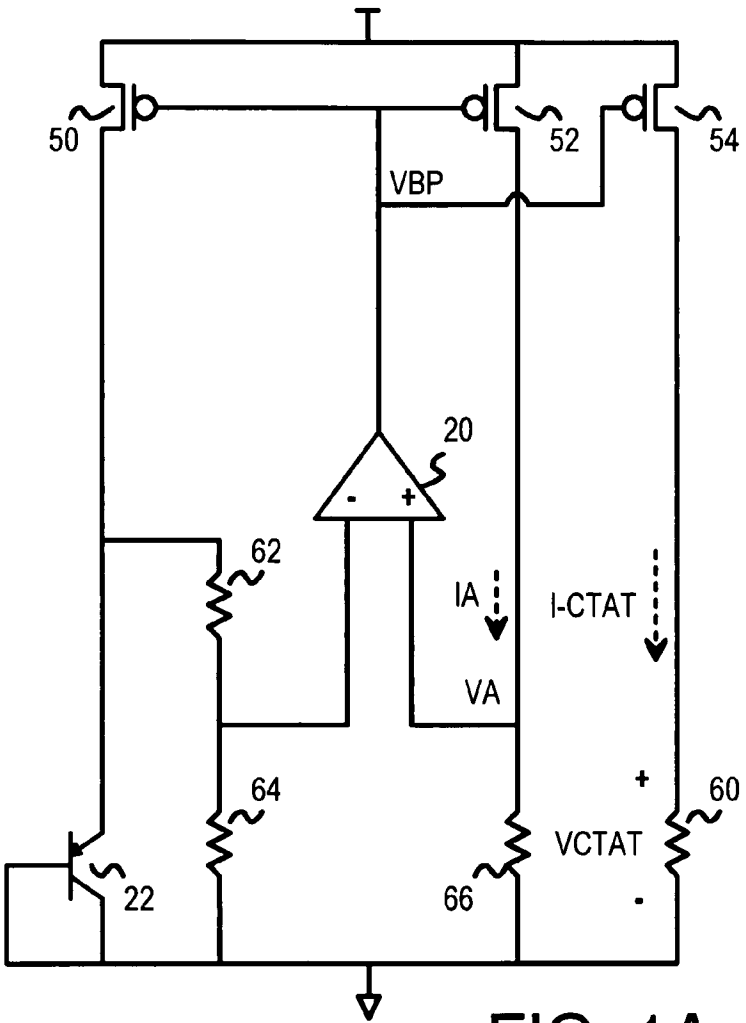
FIG. 1A is a schematic of a first stage of a bandgap reference circuit that produces a current that is complementary-to-absolute-temperature.

FIG. 1A is a schematic of a first stage of a bandgap reference circuit that produces a current that is complementary-to-absolute-temperature. PNP transistor 22 has its base and collector grounded, and produces a base-emitter voltage Vbe at its emitter when PNP transistor 22 is conducting current. This base-emitter voltage decreases fairly linearly with temperature.

PMOS transistor 50 supplies current to the emitter of PNP transistor 22 to turn it on when the power supply on the source of PMOS transistor 50 is approaching 1 volt. The base-emitter voltage Vbe on the emitter of PNP transistor 22 is divided by resistors 62, 64, producing a voltage applied to the inverting input of op amp 20. The non-inverting input of op amp 20 is the voltage Va, which is generated by a current mirrored to PMOS mirror transistor 52 that passes through Va resistor 66.

Op amp 20 adjusts the voltage of its output, Vbp, depending on the voltage difference between its inputs. When Va is higher than the voltage between resistors 62, 64, op amp 20 raises Vbp, causing less current Ia to flow through PMOS minor transistor 52, and the decreased current Ia passes through Va resistor 66, causing Va to fall. At steady-state, Va is driven by op amp 20 to be equal to the voltage between resistors 62, 64.

The gates of PMOS transistors 50, 52, 54 are tied together and driven to voltage Vbp by the output of op amp 20. Thus the current through PMOS transistor 50 is mirrored to PMOS mirror transistor 52, which produces current Ia, and PMOS mirror transistor 54, which produces current Ictat. The sizes of PMOS mirror transistors 52, 54 can be larger than the size of PMOS transistor 50 to ramp up the currents that a mirrored, but is assumed to be equal in the equations below.

As bias voltage Vbp falls, the excess current through PMOS transistor 50 is easily discharged to ground through PNP transistor 22 with little change in voltage Vbe, since the current through a PNP transistor is exponentially dependent on the base-emitter voltage. Thus the reference voltage is relatively undisturbed by feedback from op amp 20 to PMOS transistor 50.

The mirrored current through PMOS minor transistor 54, Ictat, passes through summing resistor 60 to ground. The voltage across summing resistor 60 (Vctat) generated by the current Ictat is complementary to the absolute temperature.

FIG. 1B shows that the Vctat voltage across summing resistor 60 decreases as temperature increases. Curve 102 is the voltage across summing resistor 60 as a function of temperature.

The current equation for Ictat can be generated by combining equations for Va and Ia:

$$Va=Vbe(R64/(R62+R64))$$

$$Ia=Va/R66$$

$$Ictat=Ia=Va/R66=Vbe(R64/(R62+R64))/R66$$

$$Ictat=(Vbe/R66)*(R64/(R62+R64))$$

Since Vbe is complementary to absolute temperature, Ictat is also complementary-to-absolute temperature.

Figure 2B:
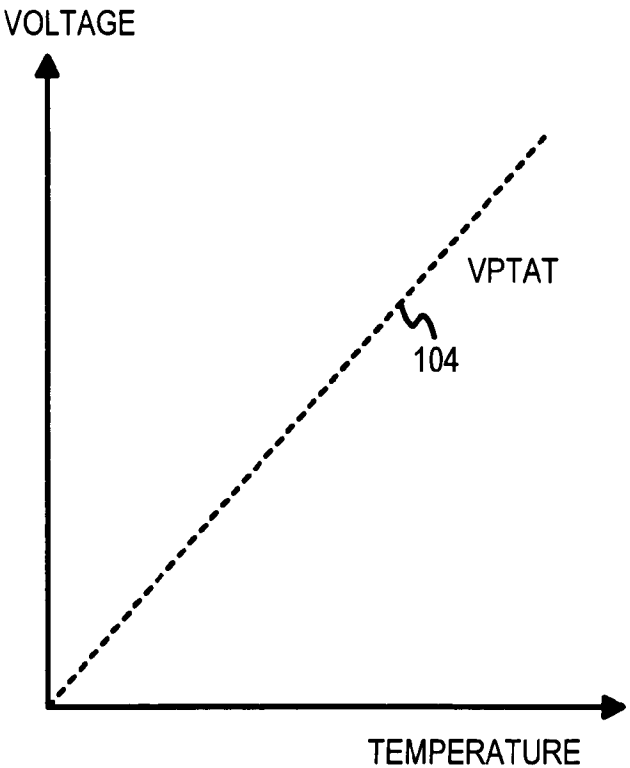
FIG. 2B shows that the second-stage voltage Vptat is proportional to temperature.
Figure 2A:
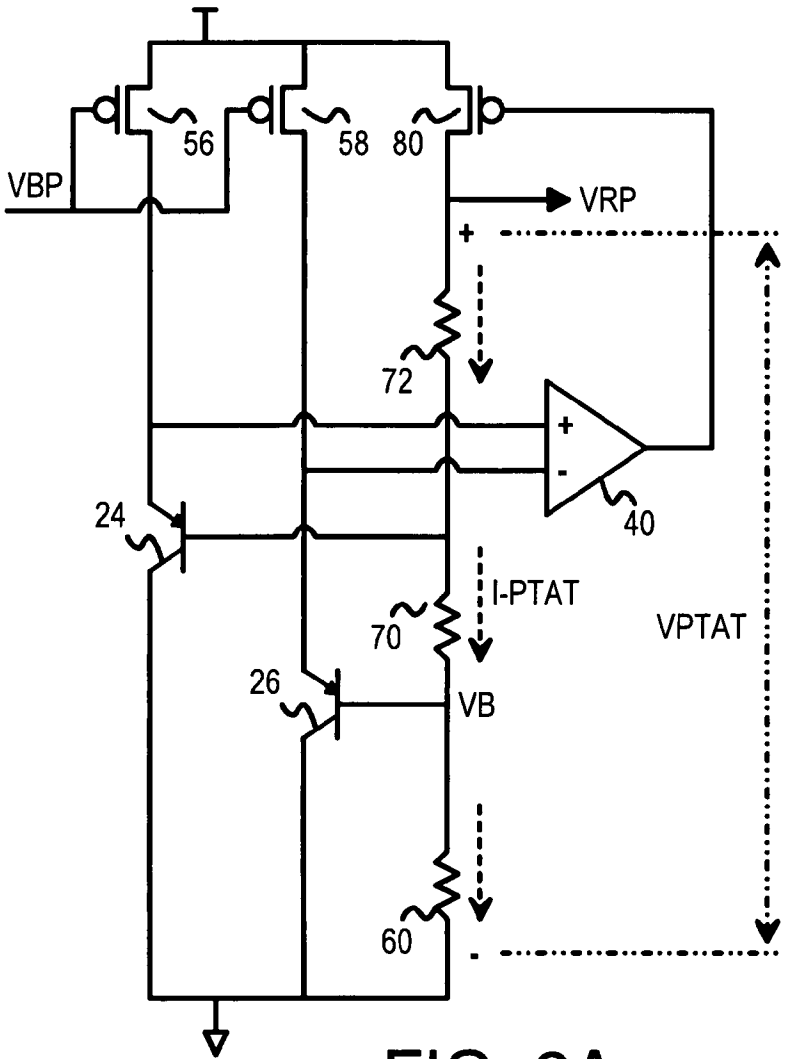
FIG. 2A is a schematic of a second stage of a bandgap reference circuit that produces a current that is proportional-to-absolute-temperature.

FIG. 2A is a schematic of a second stage of a bandgap reference circuit that produces a current that is proportional-to-absolute-temperature. PMOS mirror transistors 56, 58 have their gates driven by Vbp from op amp 20 (FIG. 1A), so that the current from PMOS transistor 50 is mirrored to PMOS transistors 56, 58.

In a first leg, PNP transistor 24 has its emitter connected to receive the mirrored current through PMOS minor transistor 56, and this emitter voltage is applied to the non-inverting (+) input of op amp 40. The base voltage of PNP transistor 24 is generated between resistors 72, 70.

In a second leg, PNP transistor 26 has its emitter connected to receive the mirrored current through PMOS minor transistor 58, and this emitter voltage is applied to the inverting (−) input of op amp 40. The base voltage of PNP transistor 26 is generated between resistors 70, 60.

The third leg of the second stage has op amp 40 driving the gate of PMOS output transistor 80. The drain of PMOS output transistor 80 is voltage Vrp. The current generated by PMOS output transistor 80 flows through the series of resistors 72, 70, 60 to ground. Base voltages to PNP transistors 24, 26 are generated at intermediate points in the series of resistors 72, 70, 60, with voltage Va being applied to the base of PNP transistor 26. Current Iptat flows through resistor 70. A PTAT loop generates current Iptat. The PTAT loop includes the negative input of op amp 40 through PMOS output transistor 80 to adjust voltage VB, and adjustments in VB are applied to the base of PNP transistor 26 to adjust the collector voltage, which is the positive input to op amp 40. Op amp 40 forces the collector voltages of PNP transistors 24, 26 to be equal. This ultimately sets Iptat.

Op amp 40 adjusts the gate voltage of PMOS output transistor 80 until the two inputs of op amp 40 are equal in voltage. When the non-inverting (+) input is higher than the inverting (−) input, op amp 40 raises the gate voltage, causing a reduction in current through PMOS output transistor 80. The reduced current lowers the base voltages to PNP transistors 24, 26, causing both inputs of op amp 40 to drop. However, since the base of PNP transistor 24 passes through an extra resistor 70 compared to the base of PNP transistor 26, the base voltage of PNP transistor 24 drops more than the base voltage of PNP transistor 26 does, causing PNP transistor 24 to draw more current and pull its emitter voltage down more than PNP transistor 26. Thus the + input to op amp 40 falls more than the − input. The feedback continues until the two inputs are equal.

FIG. 2B shows that the second-stage voltage Vptat is proportional to temperature. Curve 104 shows that voltage Vptat rises linearly as temperature rises.

The voltages on the inputs of op amp 40 are:

$$Vopamp+=Vbe24+Iptat*R70+VB$$

$$Vopamp-=Vbe26+VB$$

At steady state, the two op amp inputs are equal in voltage:

$$Vopamp+=Vopamp-$$

$$Vbe24+Iptat*R70+VB=Vbe26+VB$$

$$Vbe24+Iptat*R70=Vbe26$$

$$Iptat*R70=Vbe26-Vbe24$$

$$Iptat=(Vbe26-Vbe24)/R70$$

Since the transistor current depends exponentially on its Vbe:

$$I=Isat*(\exp(Vbe/Vt)-1)$$

where the thermal voltage Vt=kT/q, and T is absolute temperature, q is the electron charge and k is Boltzmann's constant. Isat is the saturation current.

$$Vbe24=Vt\ \ln(I24/Is24) \text{ for transistor 24, and}$$

$$Vbe26=Vt\ \ln(I26/Is26) \text{ for transistor 26.}$$

Where I24 is the emitter current and Is24 is the saturated current for transistor 24. The saturated current $Is=BT^3e^{(-VGO/VT)}$ where B is the proportional constant and VGO is the silicon bandgap voltage.

The voltage across resistor 70 is:

$$VR70=Vbe26-Vbe24$$

Substituting for Vbe26 and Vbe24:

$$VR70=Vt\ \ln(I26/Is26)-Vt\ \ln(I24/Is24)$$

Rearranging:

$$VR70=Vt\ \ln((I26*Is24)/(Is26*I24)$$

When transistors 24, 26 are matched in size. Is24/Is26=n, which is the ratio of sizes of PNP transistors 24, 26.

$$VR70=Vt\ \ln(n)$$

Since VR70=Iptat*R70, when Iptat is the current flowing through resistor 70:

$$Iptat=Vt\ \ln(n)/R70$$

Since the difference in Vbe's is proportional to temperature, and Vt ln(n) is also proportional to temperature, Iptat is proportional to temperature. Thus while the first stage (FIG. 1A is complementary to temperature, the second stage (FIG. 2A) is proportional to temperature.

Figure 3B:
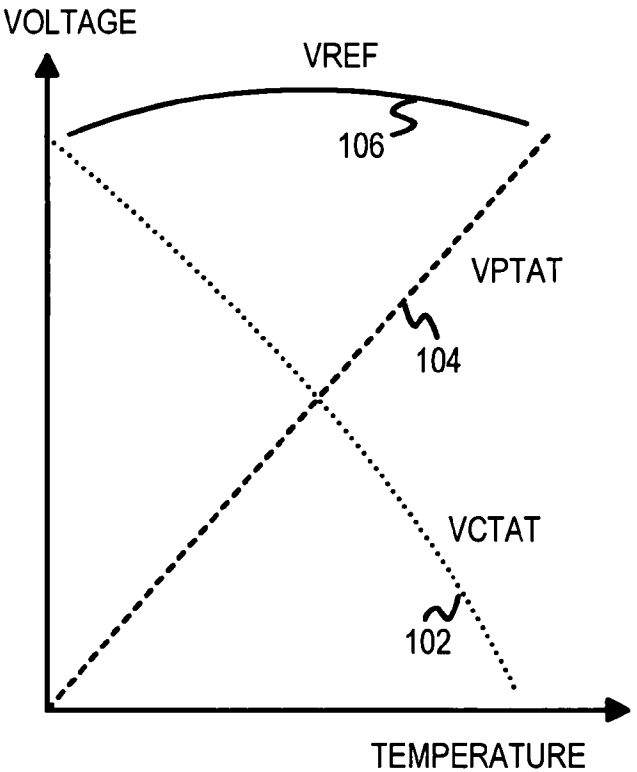
FIG. 3B shows that summing a complementary voltage from the first stage with a proportional voltage from the second stage produces a temperature-compensated reference voltage.
Figure 3A:
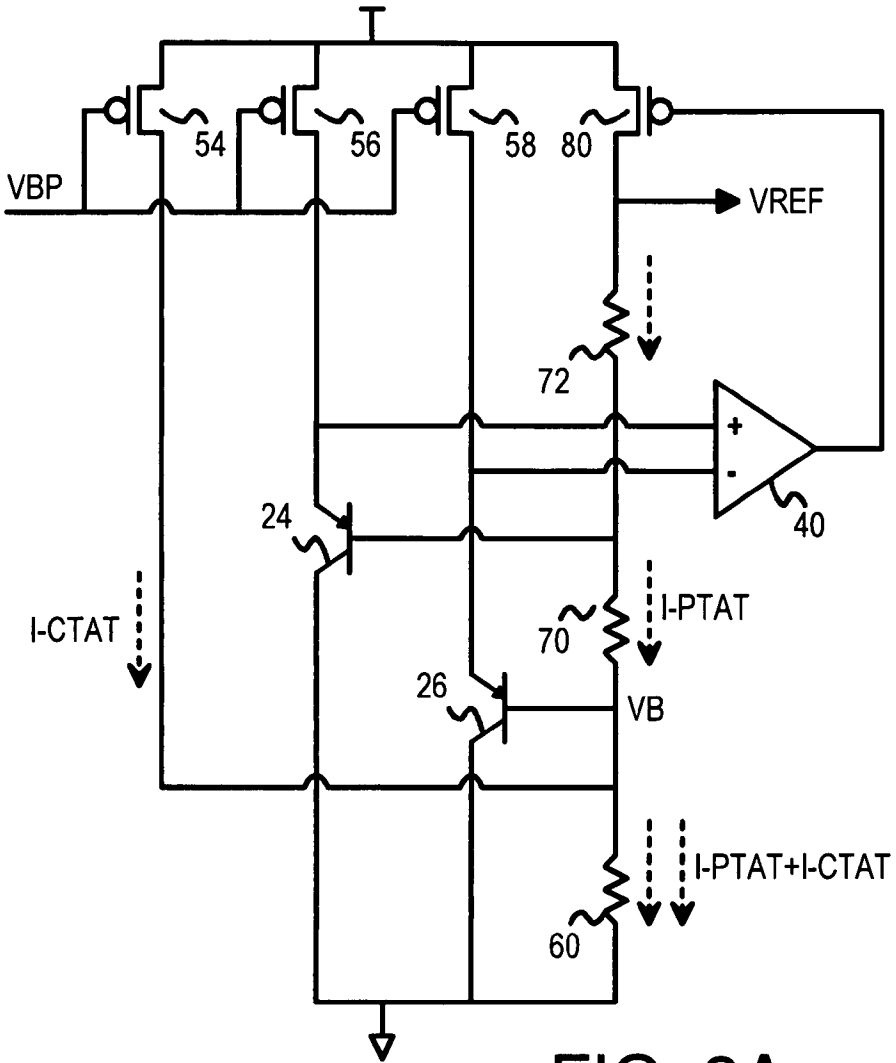
FIG. 3A is a schematic of summing complementary and proportional currents in two-stage bandgap reference circuit that compensates for temperature using both complementary and proportional currents.

FIG. 3A is a schematic of summing complementary and proportional currents in two-stage bandgap reference circuit that compensates for temperature using both complementary and proportional currents. The complementary-to-absolute-temperature current Ictat generated by the first stage in FIG. 1A is combined with the proportional-to-absolute-temperature current Iptat generated by the second stage in FIG. 2A. Current Ictat flows through resistor 60 (FIG. 1A) while current Iptat flows through resistor 60 in FIG. 2A. In a two-stage circuit, these are the same resistor, summing currents Ictat and Iptat.

PMOS minor transistor 54 generates current Ictat from the first stage, which flows through resistor 60 to ground. However, resistor 60 is also part of the second state, and receives current Iptat from resistor 70. Thus the sum of complementary current Ictat and proportional current Iptat flows through summing resistor 60.

FIG. 3B shows that summing a complementary voltage from the first stage with a proportional voltage from the second stage produces a temperature-compensated reference voltage. Summing Vctat, curve 102, produced by the complementary-to-absolute-temperature current flowing through summing resistor 60, with Vptat, curve 104, produced by the proportional-to-absolute-temperature current Iptat also flowing through summing resistor 60, and through resistors 72, 70, produces curve 106 for a reference voltage. Reference voltage Vref is relatively unaffected by temperature, as shown by flat curve 106. This is an ideal behavior for a reference voltage.

Figure 4:
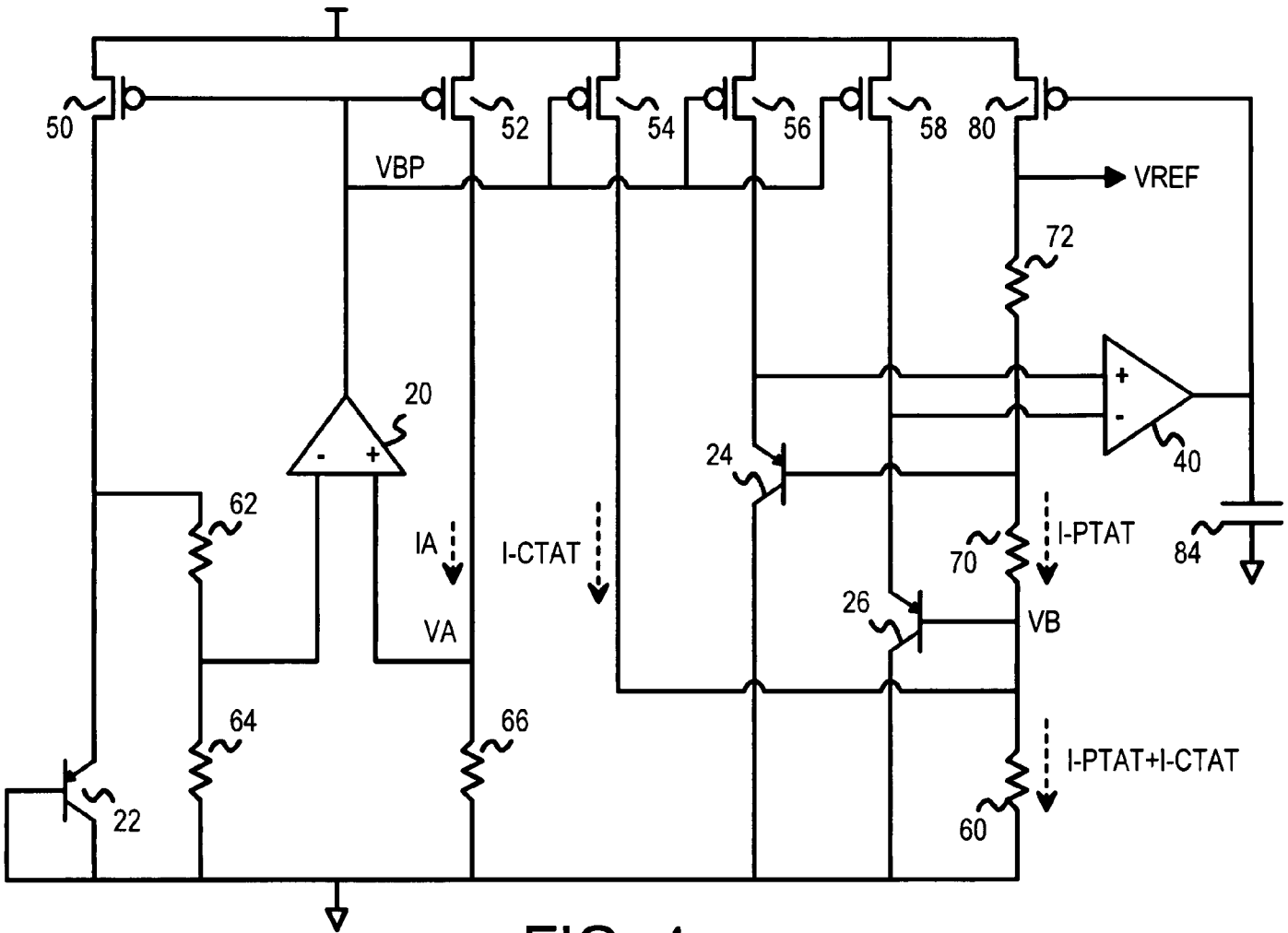
FIG. 4 is a schematic of a two-stage reference voltage circuit that sums complementary-to-absolute-temperature and proportional-to-absolute-temperature currents.

FIG. 4 is a schematic of a two-stage reference voltage circuit that sums complementary-to-absolute-temperature and proportional-to-absolute-temperature currents. In the first stage, PNP transistor 22 has its base and collector tied together and generates a voltage Vbe on its emitter, which is divided by resistors 62, 64 to generate a reference voltage applied to op amp 20. Op amp 20 adjusts bias voltage Vbp applied to the gates of PMOS transistors 50, 52, 54, 56, 58 until the inputs of op amp 20 match. Then voltage Va generated by resistor 66 equals the voltage between resistors 62, 64. The current Ia through resistor 66 is mirrored by PMOS minor transistor 54 to generate complementary-to-absolute-temperature current Ictat.

In the second stage, PNP transistors 24, 26 have base voltages generated on either side of resistor 70, and have emitters driving inputs of op amp 40. Op amp 40 adjusts the gate voltage of PMOS output transistor 80, adjusting current Iptat and the base voltages of PNP transistors 24, 26 until the emitter voltages are equal. The steady-state current, Iptat, is proportional-to-absolute-temperature because Vt ln(n) is proportional to temperature. Since n is just a ratio of transistor currents, and Vt is a parameter that increases linearly with temperature, Vt ln(n) is also proportional to temperature. This Iptat current also flows through summing resistor 60 to ground.

Both currents Ictat from the first stage and Iptat from the second stage flow through summing resistor 60, producing a total voltage drop through PMOS output transistor 80 of:

$$VB=Ictat*R60+Iptat*R60$$

The reference voltage output by the drain of PMOS output transistor 80, Vref, also includes the voltage drops through resistors 70, 72, which only have current Iptat flowing through them:

$$Vref=Iptat*(R72+R70)+Iptat*R60+Ictat*R60$$

$$\text{When } Vptat=Iptat*(R72+R70+R60), \text{ then}$$

$$Vref=Vptat+Vctat$$

Thus the reference voltage Vref is the combination of proportional-to-absolute-temperature and complementary-to-absolute-temperature voltage drops caused by proportional-to-absolute-temperature and complementary-to-absolute-temperature currents Iptat, Ictat.

Positive and negative compensation loops are formed inside the second stage. A positive loop is formed by PNP transistor 24, the + input of op amp 40 driving the gate of PMOS output transistor 80, which adjusts Iptat current through resistor 72 to adjust the base voltage of PNP transistor 24. A negative loop is formed by PNP transistor 26, the – input of op amp 40 driving the gate of PMOS output transistor 80, which adjusts Iptat current through resistors 72, 70 to adjust the base voltage VB of PNP transistor 26. The negative loop is larger than the positive loop since it includes an extra resistor 70.

These feedback loops provide good load line regulation. Coupling capacitor 84 can be adjusted in size for dominant pole compensation to produce a stable total loop gain. Other filers such as R-C networks could be substituted for coupling capacitor 84.

Figure 5:
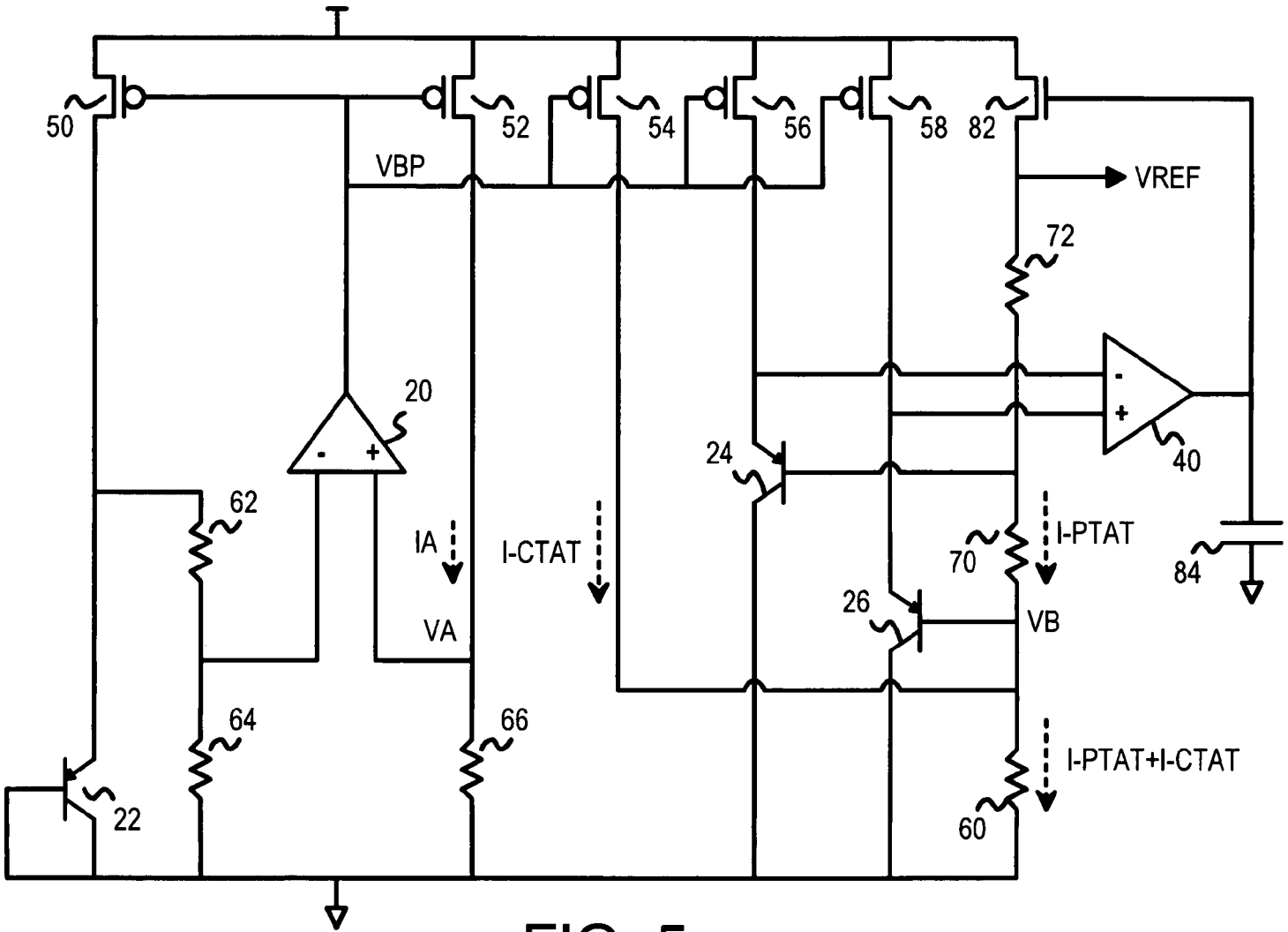
FIG. 5 shows an alternative reference circuit using a source follower driver.

FIG. 5 shows an alternative reference circuit using a source follower driver. FIG. 4 used PMOS output transistor 80 to generate Iptat and drive current to the load on Vref. Rather than use a common-source PMOS transistor with its source tied to power, an NMOS transistor may be subsisted. FIG. 5 shows that NMOS output transistor 82 has its gate driven by op amp 40, and has its drain connected to the Vdd power supply, while its source drives the Iptat current and any load current to Vref. This source follower arrangement can be useful for some voltage regulator applications when larger currents are needed to drive Vref. The source follower a better choice when better line regulation is required with a higher supply voltage. A PMOS output transistor tends to be better with lower supply voltages.

The inputs to op amp 40 are swapped in comparison to FIG. 4. When the non-inverting (+) input is higher than the inverting (−) input, op amp 40 raises the gate voltage, causing an increase in the gate-to-source voltage and current through NMOS output transistor 82.

Figure 6:
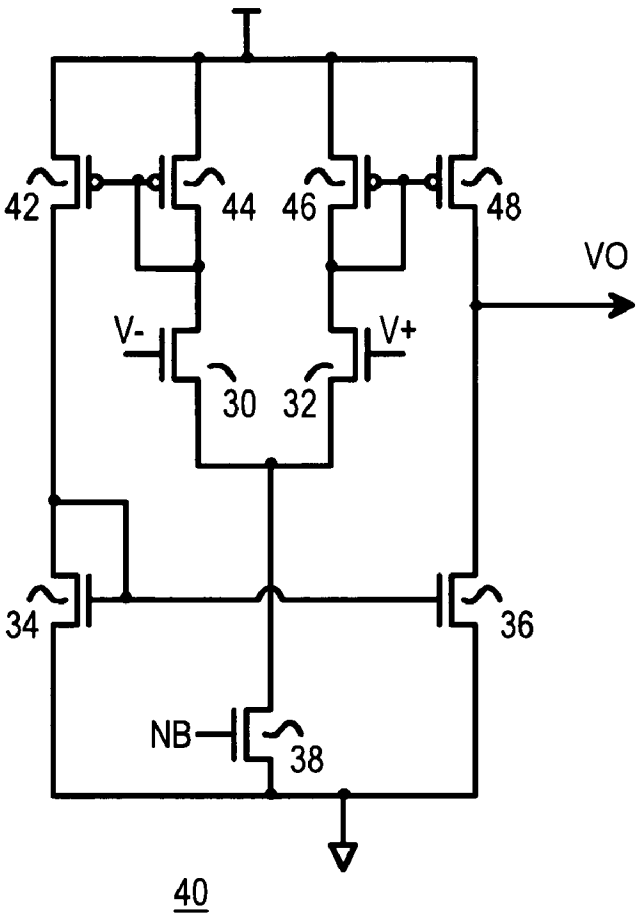
FIG. 6 is a schematic of the op amp in the second stage.

FIG. 6 is a schematic of the op amp in the second stage. Op amp 40 has a non-inverting input V+ applied to the gate of differential transistor 32 and an inverting input V− applied to the gate of differential transistor 30. The sources of NMOS differential transistors 30, 32 are connected together and to current sink transistor 38, which has its gate biased by bias voltage NB.

Current is steered between differential transistors 30, 32, depending on the voltage difference of V+, V−. When V+ is lower than V−, more current flows through differential transistor 30 than through differential transistor 32, so the gate and drain of PMOS current source transistor 44 are driven lower to increase the current flow through transistors 44, 30. The lower gate voltage of PMOS current source transistor 44 is also applied to the gate of PMOS current source transistor 42, and the increased current through PMOS current source transistor 42 causes the drains between transistors 42, 34 to rise in voltage. The drain voltage is tied to the gates of NMOS transistors 34, 36, causing output node Vo, the drain of NMOS transistor 36, to go lower.

The lower V+ causes less current to flow through differential transistor 32 and PMOS current source transistors 46, 48, causing output Vo to fall.

Figure 7:
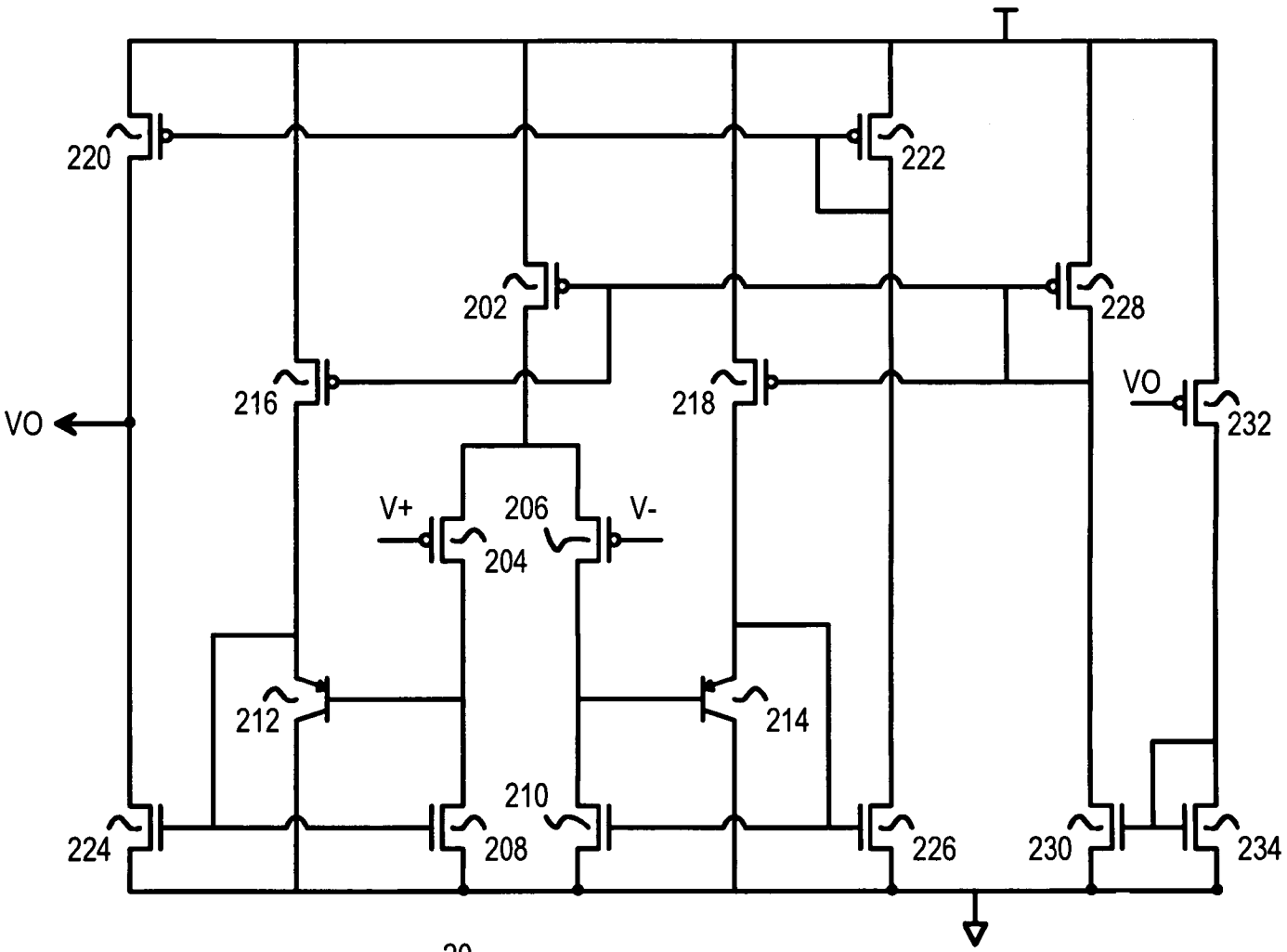
FIG. 7 is a schematic of the op amp in the first stage.

FIG. 7 is a schematic of the op amp in the first stage. Op amp 20 has a non-inverting input V+ applied to the gate of differential transistor 204 and an inverting input V− applied to the gate of differential transistor 206. The sources of PMOS differential transistors 204, 206 are connected together and to PMOS current source transistor 202. The drain of PMOS differential transistors 204, 206 connect to drains of NMOS minor transistors 208, 210, and also drive bases of PNP transistors 212, 214. PNP transistor 212 has its collector grounded and its emitter driven by current through PMOS transistor 216; its emitter also drives the gates of NMOS transistors 224, 208.

PNP transistor 214 has its collector grounded and its emitter driven by current through PMOS transistor 218; its emitter also drives the gates of NMOS transistors 226, 210.

NMOS transistor 226 has its drain connected to the gate and drain of PMOS transistor 222, which also is the gate of PMOS transistor 220. PMOS transistor 220 has its drain driving output Vo, which is also driven by the drain of NMOS transistor 224.

The voltage difference V+, V− are amplified first by differential transistors 204, 206, then by PNP transistors 212, 214, and finally are buffered by NMOS transistors 224, 226, and PMOS transistors 220, 222.

The gates of PMOS transistors 202, 216, 218, are connected together and driven by the drain and gate of PMOS transistor 228, which also connects to the drain of NMOS transistor 230. The gate of NMOS transistor 230 is driven by the gate and drain of NMOS transistor 234. Output signal Vo is fed back to the gate of PMOS transistor 232 to drive current through NMOS transistor 234 to generate the gate bias for PMOS transistors 202, 216, 281 in the primary and secondary amplifying portions of the circuit.

Alternate Embodiments

Several other embodiments are contemplated by the inventors. For example. Several other embodiments are contemplated by the inventors. For example p-channel and n-channel transistors could be swapped, with p-channel transistors being used as current sources and n-channel transistors used for the sub-threshold transistors and charging transistors rather than p-channel transistors. NPN rather than PNP transistors could be substituted for some CMOS processes. This may be beneficial for processes such as n-substrate processes or dual-well processes.

Additional components may be added at various nodes, such as resistors, capacitors, inductors, transistors, etc., and parasitic components may also be present. Enabling and disabling the circuit could be accomplished with additional transistors or in other ways. Pass-gate transistors or transmission gates could be added for isolation.

Inversions may be added, or extra buffering. The final sizes of transistors and capacitors may be selected after circuit simulation or field testing. Metal-mask options or other programmable components may be used to select the final capacitor, resistor, or transistor sizes.

When a p-channel (PMOS) output transistor is used, a low-dropout (LDO) voltage regulator may be obtained with excellent frequency characteristics. Miller compensation may be provided rather than just using a coupling capacitor for pole compensation. Output and power-supply noise may be filtered out or otherwise compensated for. However, p-channel transistor tend to have lower current drive per unit size than n-channel transistors, so an NMOS source-follower may be desirable for some applications requiring higher current drive.

The circuit designer may choose the resistor to have a ratio that produces the desired reference voltage. While Complementary-Metal-Oxide-Semiconductor (CMOS) transistors have been described, other transistor technologies and variations may be substituted, and materials other than silicon may be used, such as Galium-Arsinide (GaAs) and other variations.

While positive currents have been described, currents may be negative or positive, as electrons or holes may be considered the carrier in some cases. Charging and discharging may be interchangeable terms when referring to carriers of opposite polarity. Currents may flow in the reverse direction.

The power supply may be less than 2.0 volts, such as 1.8 volts, 1.5 volts, 1.2 volts, or 1.0 volts. The generator circuit begins to operate when the power supply reaches about 0.9 volts in simulations.

While the term "bandgap" has been used, this is something of a misnomer, since the base-emitter voltage of the PNP transistor provides the reference voltage, rather than a bandgap. However, the term bandgap is nevertheless widely used for these circuits.

The background of the invention section may contain background information about the problem or environment of the invention rather than describe prior art by others. Thus inclusion of material in the background section is not an admission of prior art by the Applicant.

Any methods or processes described herein are machine-implemented or computer-implemented and are intended to be performed by machine, computer, or other device and are not intended to be performed solely by humans without such machine assistance. Tangible results generated may include reports or other machine-generated displays on display devices such as computer monitors, projection devices, audio-generating devices, and related media devices, and may include hardcopy printouts that are also machine-generated. Computer control of other machines is another a tangible result.

Any advantages and benefits described may not apply to all embodiments of the invention. When the word "means" is recited in a claim element, Applicant intends for the claim element to fall under 35 USC Sect. 112, paragraph 6. Often a label of one or more words precedes the word "means". The word or words preceding the word "means" is a label intended to ease referencing of claim elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC Sect. 112, paragraph 6. Signals are typically electronic signals, but may be optical signals such as can be carried over a fiber optic line.

The foregoing description of the embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

We claim:

1. A temperature-compensated reference-voltage generator comprising:

a first stage that generates a complementary-to-absolute-temperature current that increases as temperature decreases;

a second stage that generates a proportional-to-absolute-temperature current that increases as temperature increases;

a summing resistor that receives both the complementary-to-absolute-temperature current from the first stage and the proportional-to-absolute-temperature current from the second stage, the summing resistor generating a summing voltage that is less dependent on temperature than either the complementary-to-absolute-temperature current or the proportional-to-absolute-temperature current;

a final voltage divider, in the second stage, that generates a reference voltage that includes the summing voltage;

an output transistor, coupled to the final voltage divider, for driving current to an output node, the output node being a node between the output transistor and the final voltage divider, the output node being driven by the output transistor to maintain the reference voltage on the output node; and a final op amp having an output that drives a gate of the output transistor, the final op amp having a first input connected to a first sensing node in the second stage, and a second input connected to a second sensing node in the second stage;

wherein the first stage further comprises:

a first reference transistor that generates a first reference voltage that is complementary-to-absolute-temperature;

a first voltage divider coupled to the first reference voltage and generating a first compare voltage;

a first op amp that receives the first compare voltage and generates a bias voltage; and a ctat current mirror transistor that receives the bias voltage from the first op amp, and generates the complementary-to-absolute-temperature current applied to the summing resistor, wherein the ctat current minor transistor is connected to the summing resistor;

a first current minor transistor that receives the bias voltage from the first op amp and generates a first current;

wherein the first current minor transistor is coupled to the first reference transistor and to the first voltage divider;

a second current minor transistor that receives the bias voltage from the first op amp and generates a second current;

a compare resistor that receives the second current and generates a second compare voltage that is applied to the first op amp, the first op amp comparing the first compare voltage to the second compare voltage to generate the bias voltage;

wherein the first reference transistor is a bipolar transistor having a base and a collector tied together and an emitter connected to the first reference transistor and to the first voltage divider;

wherein an emitter voltage of the first reference transistor is a voltage that falls with increasing absolute temperature, whereby the reference voltage includes the summing voltage that sums the complementary-to-absolute-temperature and proportional-to-absolute-temperature currents.

2. The temperature-compensated reference-voltage generator of claim 1 wherein the second stage further comprises:

a first sensing transistor coupled to the first sensing node and having a base connected to a first intermediate node in the final voltage divider;

a second sensing transistor coupled to the second sensing node and having a base connected to a base node between the final voltage divider and the summing resistor;

wherein the final voltage divider comprises a first final resistor coupled between the output node and the first intermediate node, and a second final resistor coupled between the first intermediate node and the base node;

wherein the final voltage divider generates the proportional-to-absolute-temperature current applied to the summing resistor.

3. The temperature-compensated reference-voltage generator of claim 2 wherein the second stage further comprises:

a first sensing current minor transistor that receives the bias voltage from the first op amp and is connected to drive current to the first sensing node; and a second sensing current minor transistor that receives the bias voltage from the first op amp and is connected to drive current to the second sensing node.

4. The temperature-compensated reference-voltage generator of claim 3 wherein the first reference transistor, the first sensing transistor, and the second sensing transistor are parasitic PNP transistors in a complementary metal-oxide-semiconductor (CMOS) process.

5. The temperature-compensated reference-voltage generator of claim 4 wherein the first current minor transistor, the second current minor transistor, the ctat current mirror transistor, the first sensing current mirror transistor, and the second sensing current mirror transistor are p-channel transistors having sources connected to a power supply of less than 2 volts, and gates connected to the bias voltage generated by the first op amp.

6. The temperature-compensated reference-voltage generator of claim 5 wherein the collector and base of the first reference transistor, and lower terminals of the first voltage divider and the compare resistor are grounded;

wherein the collector of the first sensing transistor, the collector of the second sensing transistor, and a lower terminal of the summing resistor are grounded.

7. The temperature-compensated reference-voltage generator of claim 6 wherein the power supply has a voltage of 1.0 volt.

8. The temperature-compensated reference-voltage generator of claim 2 further comprising:

a coupling capacitor coupled to the gate of the output transistor that is driven by the final op amp, the coupling capacitor having a capacitance size selected for dominant pole compensation to produce a stable total loop gain.

9. The temperature-compensated reference-voltage generator of claim 2 wherein the output transistor is a p-channel transistor having a source connected to a power supply and a drain connected to the output node and a gate driven by the final op amp.

10. The temperature-compensated reference-voltage generator of claim 2 wherein the output transistor is an n-channel transistor having a drain connected to a power supply and a source connected to the output node and a gate driven by the final op amp, wherein the output transistor is a source-follower.

11. A voltage generator comprising:

a first bipolar transistor connected to a first node;

a first current minor transistor connected to the first node, and having a gate receiving a bias voltage;

a first resistor connected between the first node and a first compare node;

a second resistor connected to the first compare node;

a second current minor transistor connected to a second node, and having a gate receiving the bias voltage;

a third resistor connected to the second node;

a first op amp receiving the first node and the second node as inputs, and generating the bias voltage as an output;

a third current minor transistor connected to a summing node, and having a gate receiving the bias voltage;

a summing resistor connected to the summing node;

a first current transistor connected to a first sensing node;

a first sensing bipolar transistor having a first terminal connected to the first sensing node, and a base terminal connected to a first base node;

a second current transistor connected to a second sensing node;

a second sensing bipolar transistor having a first terminal connected to the second sensing node, and a base terminal connected to the summing node;

a second op amp receiving the first sensing node and the second sensing node as inputs, and generating a feedback voltage as an output;

an output transistor having a gate receiving the feedback voltage from the second op amp, and connected to an output node;

a fourth resistor coupled between the output node and the first base node; and a fifth resistor coupled between the first base node and the summing node, wherein the output node has a reference voltage that is generated by the voltage generator.

12. The voltage generator of claim 11 wherein the first bipolar transistor comprises a PNP transistor that has a collector and a base connected to a ground and wherein the first node is connected to an emitter of the first bipolar transistor;

wherein the first sensing bipolar transistor comprises a PNP transistor that has a collector connected to the ground and an emitter connected to the first sensing node;

wherein the second sensing bipolar transistor comprises a PNP transistor that has a collector connected to the ground and an emitter connected to the second sensing node;

wherein the second resistor has a terminal connected to the ground;

wherein the third resistor has a terminal connected to the ground;

wherein the summing resistor has a terminal connected to the ground.

13. The voltage generator of claim 12 wherein the output transistor is a p-channel transistor having a source connected to a power supply.

14. The voltage generator of claim 12 wherein the output transistor is an n-channel transistor having a source connected to the output node and a drain connected to a power supply.

15. The voltage generator of claim 13 wherein the first current minor transistor comprises a p-channel transistor having a source connected to a power supply;

wherein the second current minor transistor comprises a p-channel transistor having a source connected to the power supply;

wherein the third current minor transistor comprises a p-channel transistor having a source connected to the power supply;

wherein the first current transistor comprises a p-channel transistor having a source connected to the power supply;

wherein the second current transistor comprises a p-channel transistor having a source connected to the power supply, wherein the power supply is less than 2.0 volts.

16. The voltage generator of claim 15 wherein the first current transistor has a gate receiving the bias voltage;

wherein the second current transistor has a gate receiving the bias voltage.

17. A compensating voltage generator circuit comprising:

first stage means for generating a complementary-to-absolute-temperature current that increases as temperature decreases;

second stage means for generating a proportional-to-absolute-temperature current that increases as temperature increases;

summing resistor means, receiving both the complementary-to-absolute-temperature current from the first stage means and the proportional-to-absolute-temperature current from the second stage means, for generating a summing voltage that is less dependent on temperature than either the complementary-to-absolute-temperature current or the proportional-to-absolute-temperature current;

final voltage divider means for generating a reference voltage that includes the summing voltage;

output transistor means, coupled to the final voltage divider means, for driving current to an output node, the output node being a node between the output transistor means and the final voltage divider means, the output node being driven by the output transistor means to maintain the reference voltage on the output node;

final operational amplifier means for driving a gate of the output transistor means, the final operational amplifier means having a first input connected to a first sensing node in the second stage means, and a second input connected to a second sensing node in the second stage means;

first reference transistor means for generating a first reference voltage that is complementary-to-absolute-temperature;

first voltage divider means, coupled to the first reference voltage, for generating a first compare voltage;

first operational amplifier means, receiving the first compare voltage, for generating a bias voltage;

ctat current minor transistor means, receiving the bias voltage, for generating the complementary-to-absolute-temperature current applied to the summing resistor means, wherein the ctat current minor transistor means is connected to the summing resistor means;

first sensing transistor means for generating a first sensing voltage on the first sensing node in response to a base connected to a first intermediate node in the final voltage divider means;

second sensing transistor means for generating a second sensing voltage on the second sensing node in response to a base connected to a base node between the final voltage divider means and the summing resistor means;

whereby the reference voltage includes the summing voltage that sums the complementary-to-absolute-temperature and proportional-to-absolute-temperature currents.

* * * * *